United States Patent [19]

DeRoss

[11] Patent Number: 4,701,137

[45] Date of Patent: Oct. 20, 1987

[54] ELECTRICAL CONNECTOR FOR COAXIAL CABLES

[75] Inventor: Robert DeRoss, Naperville, Ill.

[73] Assignee: Molex Incorporated, Lisle, Ill.

[21] Appl. No.: 800,882

[22] Filed: Jan. 6, 1986

Related U.S. Application Data

[63] Continuation of Ser. No. 596,861, Apr. 4, 1986, abandoned.

[51] Int. Cl.[4] ..... H01R 4/24

[52] U.S. Cl. ..... 439/394

[58] Field of Search ..... 339/97 R, 97 P, 98, 339/99 R; 29/868, 869, 871

[56] References Cited

U.S. PATENT DOCUMENTS

| | | | |
|---|---|---|---|
| 2,706,282 | 4/1955 | Dudra | 339/97 P |
| 3,115,541 | 12/1963 | Hanner et al. | 339/97 R |
| 3,824,528 | 7/1974 | Esser | 339/97 C |
| 3,864,011 | 2/1975 | Huber | 339/103 M |
| 3,907,396 | 9/1975 | Huber | 339/103 R |
| 3,963,319 | 6/1976 | Schumacher et al. | 339/176 MF |
| 4,080,034 | 3/1978 | Werner | 339/98 |
| 4,215,236 | 7/1980 | Reiser | 174/59 |
| 4,261,632 | 4/1981 | Nardzny | 339/97 R |
| 4,370,015 | 1/1983 | Hutter et al. | 339/99 R |
| 4,437,722 | 3/1984 | Bianchi | 339/97 P |

*Primary Examiner*—John McQuade

*Attorney, Agent, or Firm*—John W. Cornell; Louis A. Hecht

[57] ABSTRACT

An electrical connector for electrically interconnecting or splicing a plurality of coaxial cables includes a cover and a base. The cover has a plurality of U-shaped slots for the receipt of the coaxial cables and an electrically conductive metallic shield connector secured thereto. The metallic shield connector includes a plurality of electrically interconnected, downwardly extending, insulation piercing contacts for cutting through the outer insulating layers of the coaxial cables and for physically and electrically contacting and for electrically interconnecting the metallic shields of the coaxial cables. The base includes an electrically insulating substrate that has an electrically conductive central conductor connector disposed thereon. The central conductor connector includes a plurality of electrically interconnected, upwardly extending, insulation piercing contacts for cutting through the inner insulating layers of the coaxial cables and for physically and electrically contacting and electrically interconnecting the central conductors of the coaxial cables.

2 Claims, 8 Drawing Figures

ELECTRICAL CONNECTOR FOR COAXIAL CABLES

This application is a continuation of application Ser. No. 596,861, filed Apr. 4, 1984, and now abandoned.

BACKGROUND OF THE INVENTION

A. Field of the Invention

The device of the present invention generally relates to electrical connectors and, more particularly, to electrical connectors for electrically interconnecting or splicing a plurality of low voltage coaxial cables.

B. Description of the Prior Art

Electrical connectors and, more particularly, electrical connectors for electrically interconnecting or splicing a plurality of single or multiple conductor cables are old and well known in the art. Examples of such connectors are disclosed in U.S. Pat. Nos. 4,284,316; 4,324,450; 4,325,598; 4,346,958; 4,360,244; 4,365,859; and 4,391,484. In general, prior art electrical connectors for electrically interconnecting or splicing a plurality of coaxial cables have exhibited one or more design deficiencies. For example, many prior art electrical connectors have been either overly large, cumbersome, unreliable, expensive, or difficult or time consuming to assemble, or have required one or more soldering operations. A need exists in the art for a relatively small, effective reliable and inexpensive electrical connector for electrically interconnecting or splicing a plurality of coaxial cables quickly and easily without any soldering operations.

SUMMARY OF THE INVENTION

An object of the present invention is to provide a new and improved electrical connector.

Another object of the present invention is to provide a new and improved electrical connector for electrically interconnecting or splicing a plurality of coaxial cables.

Another object of the present invention is to provide a new and improved electrical connector for electrically interconnecting or splicing a plurality of coaxial cables that utilizes a first plurality of electrically interconnected insulation piercing contacts for electrically interconnecting the central conductors of the coaxial cables and a second plurality of electrically interconnected insulation piercing contacts for electrically interconnecting the outer conductors of the coaxial cables.

Another object of the present invention is to provide a new and improved electrical connector assembly or splice having a plurality of coaxial cables and an electrical connector for electrically interconnecting or splicing the coaxial cables.

Another object of the present invention is to provide a new and improved electrical splice for electrically interconnecting a plurality of coaxial cables that utilizes an electrical connector having a first plurality of electrically connected insulation piercing contacts for electrical interconnecting the central conductors of the coaxial cables through a short circuit electrical path and a second plurality of electrically connected insulation piercing contacts for electrically interconnecting the outer conductors of the coaxial cables through a short circuit electrical path.

Another object of the present invention is to provide a new and improved method for electrically interconnecting or splicing a plurality of coaxial cables.

Briefly, the present invention relates to an electrical connector for electrically interconnecting or splicing a plurality of three low voltage coaxial cables or for electrically interconnecting a low voltage coaxial cable with an electrical device. The electrical connector which may be referred to as a mass termination includes a generally T-shaped, electrically insulating cover and a base for the receipt of the three coaxial cables. An electrically conductive metallic shield connector is secured in the cover and includes a plurality of three, downwardly extending, insulation piercing contacts for cutting through the outer insulating layers of the coaxial cables and for physically and electrically contacting and electrically interconnecting the outer conductors or metallic shields of the coaxial cables en masse when the cover is placed over the base. The base of the electrical connector includes a generally T-shaped substrate that has an electrically conductive central conductor connector disposed thereon. The central conductor connector includes a plurality of three, upwardly extending, insulation piercing contacts for cutting through the inner insulating layers of the coaxial cables and for physically and electrically contacting and electrically interconnecting the central conductors of the coaxial cables. In this manner, the three coaxial cables may be easily, quickly and reliably electrically interconnected en masse through a short circuit electrical path by means of the electrical connector.

BRIEF DESCRIPTION OF THE DRAWING

The above and other objects and advantages and novel features of the present invention will become apparent from the following detailed description of the preferred embodiment of the present invention illustrated in the accompanying drawing wherein.

DESCRIPTION OF THE PREFERRED EMBODIMENT

Figure 1:
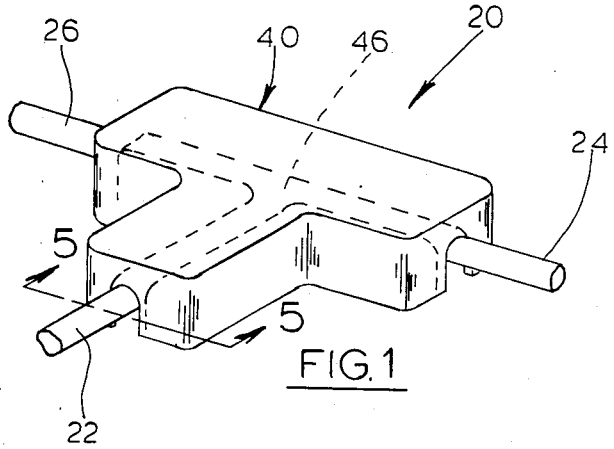
FIG. 1 is a perspective view of an electrical connector constructed in accordance with the principles of the present invention.
Figure 2:
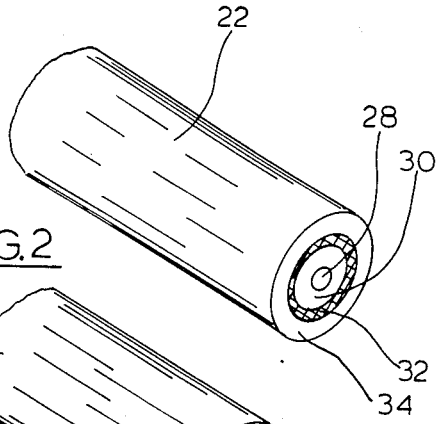
FIG. 2 is an enlarged perspective view of a coaxial cable for use with the device of FIG. 1.
Figure 3:
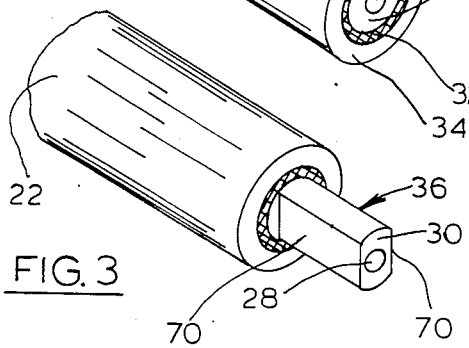
FIG. 3 is an enlarged perspective view of a coaxial cable prepared for use in the device of FIG. 1.

Referring to the drawing and initially to FIGS. 1-3, there is illustrated a new and improved electrical connector 20 constructed in accordance with the principles of the present invention. The electrical connector 20, which may be referred to as a mass termination, electrically interconnects or splices a plurality of three low voltage coaxial cables 22, 24 and 26 capable of transmitting high frequency, low power energy. Each coaxial cable 22, 24 and 26 (FIG. 2) includes a central or current carrying conductor 28; and inner dielectric insulating layer 30; an outer conductor or metallic shield 32, typically formed as metallic braiding; and an outer dielectric insulating layer, jacket or sheath 34. Each coaxial cable 22, 24 and 26 may be prepared for interconnection by the electrical connector 20 by baring and shaping an elongated portion 36 (FIG. 3) of the inner insulating layer 30.

Figure 4:
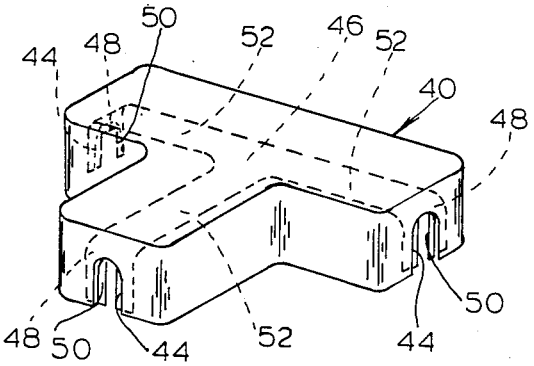
FIG. 4 is a perspective view of the cover of the device of FIG. 1.
Figure 5:
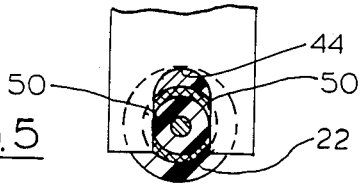
FIG. 5 is an enlarged, cross sectional view of the device of FIG. 1 taken along line 5—5 of FIG. 1.
Figure 6:
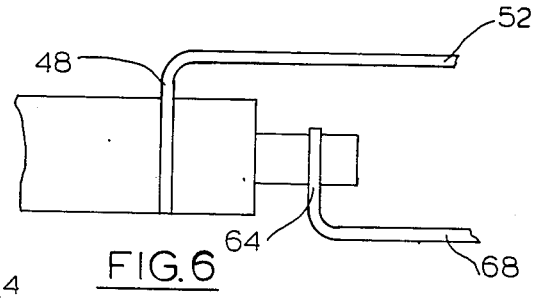
FIG. 6 is an enlarged, fragmentary, elevational view of the insulation piercing contacts of the device of FIG. 1.

In accordance with an important feature of the present invention, the electrical connector 20 includes a generally T-shaped, molded, electrically insulating cover 40 (FIG. 4) formed from a suitable dielectric material that circumscribes or defines the interior of the electrical connector 20 when disposed over a base 42 of the electrical connector 20. The cover 40 includes a plurality of three, elongated, generally U-shaped slots or openings 44 for the receipt of the cables 22, 24 and 26. An electrically conductive metallic shield connector 46 is fixedly secured in the cover 46 and includes a plurality of three, downwardly extending, insulation piercing contacts 48 for physically and electrically contacting and for electrically interconnecting the metallic shields 32 of the cables 22, 24 and 26. Each of the contacts 48 includes a plurality of laterally spaced apart, exposed knife edges 50 (FIG. 5) extending inwardly into the slots 44. When the cover 40 is disposed over the base 42 (FIG. 1) such that the cables 22, 24 and 26 are fully received in the slots 44, the knife edges 50 cut through the outer insulating jackets 34 and physically and electrically contact the metallic shields 32 of the cables 22, 24 and 26 en masse (FIGS. 5 and 6).

The shield connector 46 also includes a plurality of three, elongated, interconnected, metallic leads 52 (FIGS. 1 and 4) for electrically interconnecting the three spaced apart contacts 48 and thus the three metallic shields 32 of the cables 22, 24 and 26. The contacts 48 and the leads 52 may, in a specific embodiment, comprise integrally formed portions of a unitary metallic strip. The metallic shield connector 46 may be formed in a desired configuration and then placed, prior to a molding operation, in a mold used to form the cover 40. In this manner, the cover 40 and the shield connector 46 may be formed as a single component part of the electrical connector 20.

Figure 7:
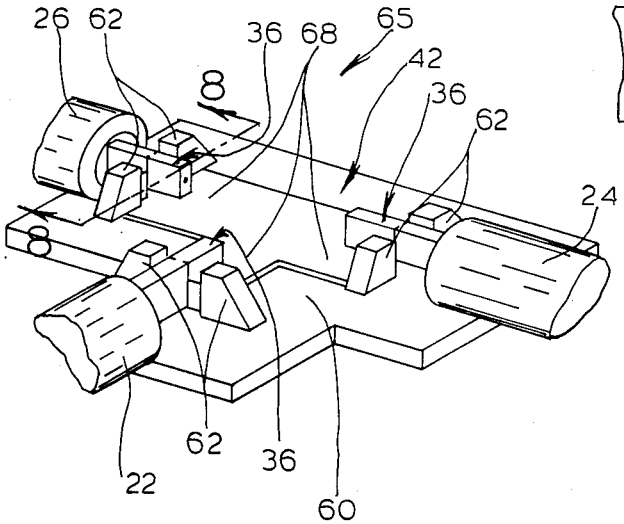
FIG. 7 is a perspective view of the base of the device of FIG. 1.
Figure 8:
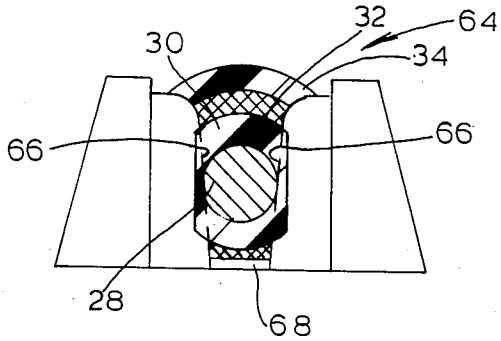
FIG. 8 is an enlarged, cross sectional view of the device of FIG. 1 taken along line 8—8 of FIG. 7.

In accordance with another important feature of the present invention, the base 42 of the electrical connector 20 includes a generally T-shaped, electrically insulating substrate 60 (FIG. 7). The substrate 60 includes a plurality of three, integrally formed, pairs of spaced apart protuberances or pedestal portions 62 extending upwardly from the inner surface of the substrate 60. One of a plurality of three, upwardly extending, insulation piercing contacts 64 of an electrically conductive central conductor connector 65 is supported by and mounted between each pair of pedestal portions 62. Each contact 64 includes a pair of laterally spaced apart, converging knife edges 66 for cutting through the elongated portion 36 of the inner insulating layer 30 and for physically and electrically contacting the central conductor 28 of the cable 22, 24 and 26 (FIGS. 6 and 8). The central conductor connector 65 also includes a plurality of elongated, interconnected, metallic leads or strips 68, secured to the substrate 60 by any suitable means, for electrically interconnecting the three contacts 64 and thus the central conductors 28 of the cables 22, 24 and 26 through a short circuit electrical path.

In accordance with a further important feature of the present invention, a pluality of two or more of the cables 22, 24 and 26 may be electrically interconnected by means of the electrical connector 20 in accordance with the following method. Initially, each cable 22, 24 and 26 is prepared as depicted in FIG. 3. Specifically, the elongated portion 36 of the inner insulating layer 30 is bared by removing an elongated portion of the outer jacket 34 and a corresponding elongated portion of the metallic shield 32. Subsequently, the elongated portion 36 of the inner insulating layer 30 may be shaped, if desired, to facilitate its receipt on the contact 64 between the pair of pedestal portions 62 (FIGS. 7 and 8) and to reduce the amount of effort required to cut through the inner insulating layer 30 in order to physically contact the central conductor 28. For example, the inner insulating layer 30 may be cut to form a plurality of two, generally parallel, spaced apart, flat or planar surfaces 70 (FIG. 3).

Subsequently, each elongated portion 36 of the cables 22, 24 and 26 (if all three cables 22, 24 and 26 are to be interconnected) is disposed fully in contact with the insulation piercing contact 64 (FIG. 8) such that the center conductor 28 is in physical and electrical contact with the converging knife edges 66. The cover 40 may then be placed over the substrate 60 so that the cables 22, 24 and 26 are received in the slots 44. The cover 40 is pressed downwardly as a mass termination until the cables 22, 24 and 26 are fully received within the slots 44, in which condition the knife edges 50 will have cut through the outer jackets 34 to physically and electrically contact the metallic shields 32 of the cables 22, 24 and 26. If desired, the cover 40 and the base 42 may be configured to interlock, for example, by a snap fit between the cover 40 and the substrate 60, to maintain the cover 40 in secure engagement with the base 42. In this manner and by means of the electrical connector 20, the coaxial cables 22, 24 and 26 may be easily, quickly and reliably electrically interconnected.

Obviously, many modifications and variations of the present invention are possible in light of the above teachings. For example, a single insulation piercing contact 64 and a single, associated, preferably oppositely extending, insulation piercing contact 48 both electrically interconnected with an electrical device may be used physically and electrically to contact the central conductor 28 and the metallic shield 32, respectively, of a single coaxial cable 22 to electrically interconnect the coaxial cable 22 and the electrical device. Thus, it is to be understood that, within the scope of the appended claims, the invention may be practiced otherwise than as specifically described hereinabove.

What is claimed and desired to be secured by Letters Patent is:

1. An electrical commoning connector for electrically commoning first and second coaxial cables, each coaxial cable having a central conductor, an inner dielectric insulating layer surrounding said central conductor, an outer conductor coaxially disposed with respect to said central conductor and surrounding said inner dielectric insulating layer and an outer dielectric insulating layer surrounding said outer conductor, at least one of said coaxial cables having a prepared end wherein a predetermined length of said outer dielectric insulating layer and a predetermined length of said outer conductor is removed from one longitudinal end thereof to expose a bared connecting portion formed by a predetermined length of said central conductor surrounded by a predetermined length of said inner dielectric insulating layer, the electical connector including a central terminal arrangement for electrically commoning the central conductors of each cable, an outer terminal arrangement for electrically commoning the outer conductors of each cable, and means for electrically insulating said central and outer terminal arrangements from each other, wherein the improvement comprises:

both of said cables having said prepared end;

said central terminal arrangement including an integral stamped first terminal member having a plurality of end plate portions each including inuslation displacing slot means for electrically connecting one of said coaxial cable center conductors;

said outer terminal arrangement comprising an integral stamped second terminal member having a plurality of end plate portions each including insulation displacing slot means for electrically connecting one of said coaxial cable outer conductors immediately adjacent said prepared cable end thereof;

said connector including opposing dielectric base and cover members, said base member mounting said first terminal member and dimensioned to overlie said first terminal member and said cover member mounting said second terminal member and dimensioned to overlie said second terminal member and said base member and matingly engaging said base member so as to align opposed pairs of insulation displacing slot means taken one from each of said first and said second terminal members and to enclose said first and said second terminal members and said prepared ends of said coaxial cables.

2. The connector of claim 1 wherein said cover member includes a plurality of wall portions, one adjacent an end plate portion of said second terminal member, each including a slot means for receiving and aligning a coaxial cable connected to an insulation displacing slot means located adjacent said end plate portion.

* * * * *

UNITED STATES PATENT AND TRADEMARK OFFICE

CERTIFICATE

Patent No. 4,701,137 Patented: October 20, 1987

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is Robert DeRoss; Steven B. Bogiel.

Signed and Sealed this Fifth Day of April 1988.

Jeffrey V. Nase
Petitions Examiner
Office of the Deputy Assistant
Commissioner for Patents